US009889485B2

(12) United States Patent
Fulco et al.

(10) Patent No.: US 9,889,485 B2
(45) Date of Patent: Feb. 13, 2018

(54) THRUSTING DEVICE FOR PIPES OR THE LIKE TO BEND IN A PIPE OR THE LIKE BENDING MACHINE

(71) Applicant: CRIPPA S.p.A., Arosio (CO) (IT)

(72) Inventors: Domenico Fulco, Arosio (IT); Luca Tufarolo, Arosio (IT)

(73) Assignee: CRIPPA S.p.A., Arosio (CO) (IT)

( * ) Notice: Subject to any disclaimer, the term of this patent is extended or adjusted under 35 U.S.C. 154(b) by 675 days.

(21) Appl. No.: 14/498,481

(22) Filed: Sep. 26, 2014

(65) Prior Publication Data

US 2015/0089991 A1 Apr. 2, 2015

(30) Foreign Application Priority Data

Oct. 2, 2013 (IT) ..... MI2013A1624

(51) Int. Cl.
*B21D 11/22* (2006.01)
*B21D 7/025* (2006.01)
*B21D 43/00* (2006.01)

(52) U.S. Cl.
CPC ..... *B21D 11/22* (2013.01); *B21D 7/025* (2013.01); *B21D 43/006* (2013.01)

(58) Field of Classification Search
CPC ..... B21D 11/22; B21D 7/025; B21D 9/00; B21D 43/006; F16L 11/111; F16L 37/113; F16L 37/107
USPC ..... 72/467
See application file for complete search history.

(56) References Cited

U.S. PATENT DOCUMENTS 4,006,621 A * 2/1977 Moshnin ..... B21D 7/025 72/151
4,412,442 A * 11/1983 Kawanami ..... B21D 7/025 72/128
7,341,281 B2 * 3/2008 Guesnon ..... F16L 37/107 285/314
7,418,908 B2 * 9/2008 Landphair ..... A01C 15/006 111/175
7,988,200 B2 * 8/2011 Krywitsky ..... F16L 37/113 285/312
2003/0034651 A1 * 2/2003 Neubauer ..... F16L 11/111 285/396
2008/0267698 A1 * 10/2008 Rinkenberger ..... B21D 9/00 403/301
2011/0148107 A1 * 6/2011 Blivet ..... F16L 37/0841 285/402
2015/0089991 A1 * 4/2015 Fulco ..... B21D 11/22 72/467

* cited by examiner

*Primary Examiner* — David B Jones
(74) *Attorney, Agent, or Firm* — Greer Burns & Crain, Ltd.

(57) ABSTRACT

A thrusting device for pipes or the like to bend in a pipe or the like bending machine suitable for a quick-acting coupling-release.

6 Claims, 4 Drawing Sheets

THRUSTING DEVICE FOR PIPES OR THE LIKE TO BEND IN A PIPE OR THE LIKE BENDING MACHINE

SCOPE OF THE INVENTION

A thrusting device for pipes or the like to bend in a pipe or the like bending machine suitable for a quick-acting coupling-release.

STATE OF THE ART

The machines used to bend pipes or the like use pipe or the like feeding devices for a progressive bending of such pipes or the like. Said devices known so far consist of at least two tools connected to each other by means of threaded ring nuts according to a screw-bolt connection method. A drawback of such tool connection consists in that its connection procedure requires a lot of time. Another drawback consists in that the connection between the tools tends to slacken because they rotate in the direction opposite to the screwing-in one, i.e. they unscrew.

DESCRIPTION OF THE INVENTION

The present invention advantageously solves the drawbacks of the thrusting devices known so far for pipes or the like to bend in pipe or the like bending machines using two tools.

Another advantage of said invention consists in that it allows a quick coupling and release of the two tools that make up the thrusting device so as to make the procedure to prepare the production of bent pipes or the like in pipe or the like bending machines quicker, easier, and more comfortable.

The present invention concerns a device of a pipe bending machine used for thrusting the pipe to bend or for thrusting products similar to said pipe. Said device comprises a first tool shaped as a rod suitable for calibration. Said first tool is called "calibration rod".

An ending portion of said first tool comprises at least one hollow draft. Said portion is preferably elbow-shaped. Said hollow draft is equipped with a convex female portion suitable for accommodating a male means and a recess suitable for the antirotation of the first tool.

In a preferred embodiment, the first tool comprises two portions, namely a first portion and a second portion, said second portion featuring said hollow draft. Said second portion is detachable from and connectable to the first portion of the first tool via connection means, preferably of the screw type. Said connection tools are suitable for rendering the two portions integral with each other. An advantage of this subdivision of the first tool into two portions is in that it prevents the need for replacing the complete first tool in the case of wear and tear of the hollow draft, which undergoes greater stresses, hence greater tear and wear, with respect to the first portion of the first tool, said second portion being that which comprises the hollow draft dedicated to the coupling and release of the first tool with/from the second tool, as illustrated below.

Therefore, subdividing the first tool into two portions makes it possible to replace the second portion of the first tool only, should the hollow draft only, not other portions of the first tool, be worn and torn, which results in evident savings of economic resources and working times. Let's consider, for instance, the time necessary to replace the complete first tool in a pipe bending machine as referred to replacing a portion thereof located at an end of said tool, thus preventing the need for withdrawing the complete first tool from the pipe bending machine.

The second tool is preferably circular-ring shaped. It is formed of two portions equipped with at least one male means suitable for being accommodated in the female portion of the first tool.

Elastic means are interposed between the two circular-ring shaped portions of the second tool.

As described above, the second tool consists of two portions: a first portion, so called because it is the first that gets in contact with the end of the first tool when the two tools couple with each other; a second portion, so called because it is the second that gets in contact with the end of the first tool when the two tool couple with each other.

In the preferred embodiment, the second portion of the second tool comprises a tooth suitable for being inserted into a recess of the first tool for antirotation, this way it is possible to overcome one of the drawbacks of the pipe thrusting devices known so far, i.e. the circumstance whereby the connection between the two tools that make up said feeding device for pipes or the like in pipe or the like bending machines becomes less and less integral.

In a variant of the preferred embodiment, the shape of the second portion of the second tool consists of a circular-shaped ring permanently connected to a rod.

The advantage of such variant consists in that the second tool, necessary to couple with the first tool, is made in one piece integral with the pipe that thrusts the pipe to bend, so as to make the thrusting action of the thrusting device according to the present invention, more accurate.

DESCRIPTION OF THE FIGURES

FIG. 1 shows a thrusting device (1) for pipe or the like to bend (2) in a pipe or the like bending machine.

Figure 1:
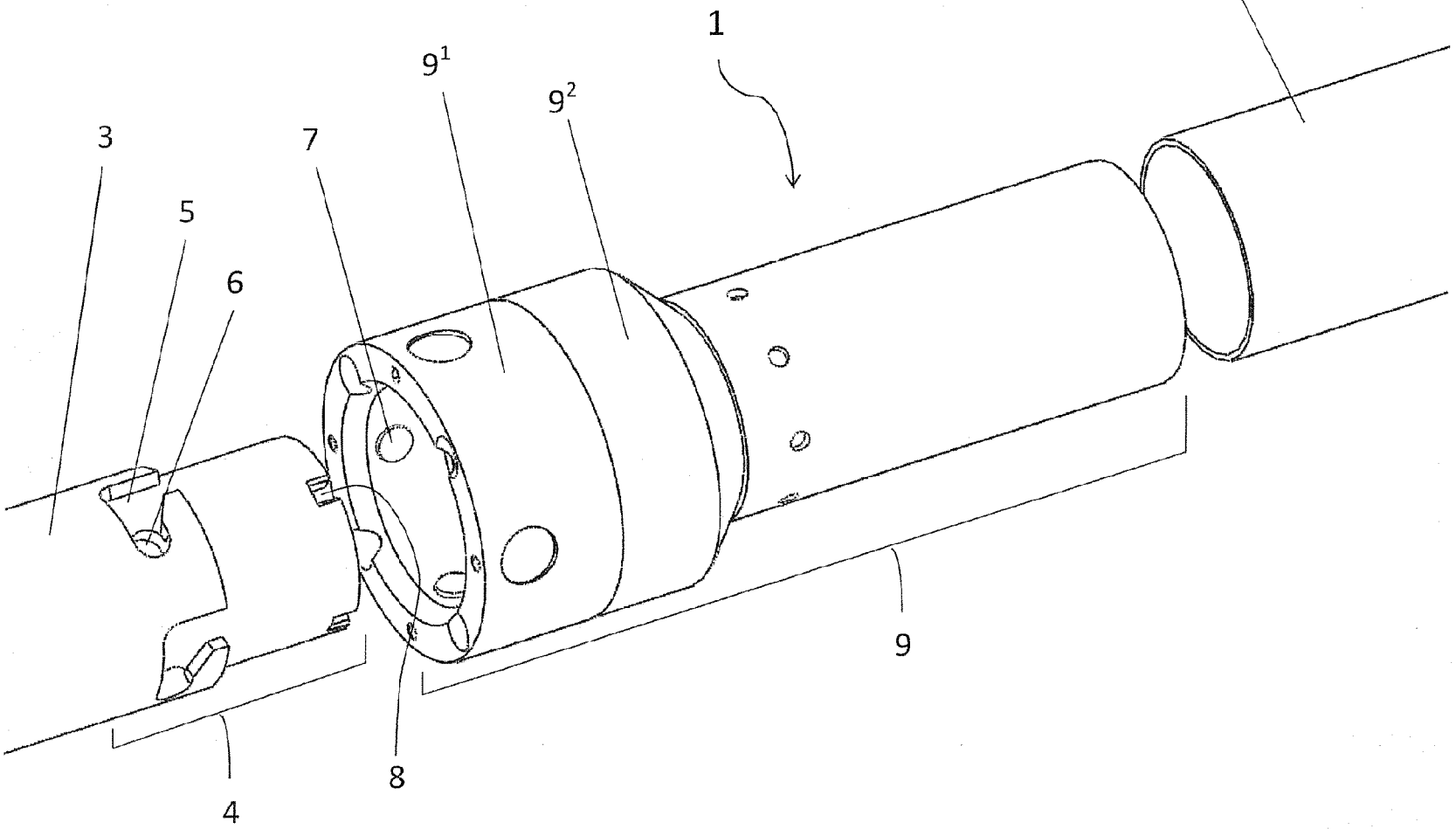
FIG. 1 shows a perspective view of the thrusting device for pipe or the like to bend in a pipe or the like bending machine.

It comprises a first tool (3) shaped as a rod suitable for calibration, called calibration rod. In said first tool there is an end (4) which comprises at least a preferably elbow-shaped hollow draft (5) equipped with a convex female means (6) suitable for accommodating a male means (7). Said first tool also comprises a recess (8) suitable for the antirotation of the first tool (3).

Said FIG. 1 also shows a preferably ring-shaped second tool (9) formed of two portions ($\mathbf{9}^1$, $\mathbf{9}^2$), equipped with at least one male means (7) suitable for being accommodated in said female portion (6) of the first tool.

Figure 2:
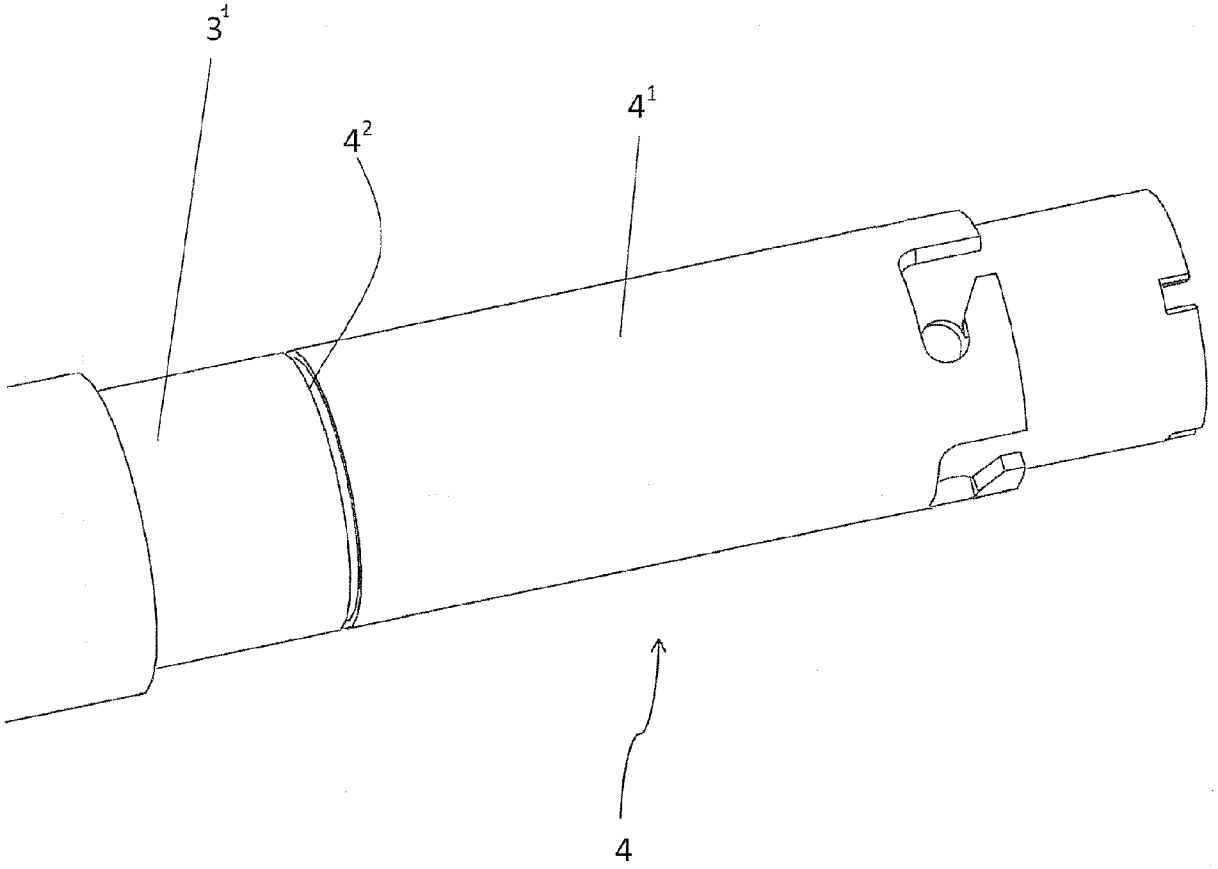
FIG. 2 shows a perspective view of the end of the tool ($\mathbf{4}^1$) connected to the rod.

FIG. 2 shows a perspective view of the first tool in the preferred embodiment, i.e. formed of two portions: a first portion ($\mathbf{3}^1$) and a second portion comprising a hollow draft. In this embodiment, the second portion is thus implemented like a tool ($\mathbf{4}^1$) autonomous with respect to the mentioned first portion ($\mathbf{3}^1$).

The tool ($\mathbf{4}^1$) is detachable from and connectable to the first portion ($\mathbf{3}^1$) of the first tool via connection means ($\mathbf{4}^2$), preferably of a screw type. Such connection means ($\mathbf{4}^2$) are suitable for making the first portion ($\mathbf{3}^1$) of the first tool integral with the tool ($\mathbf{4}^1$).

Figure 3:
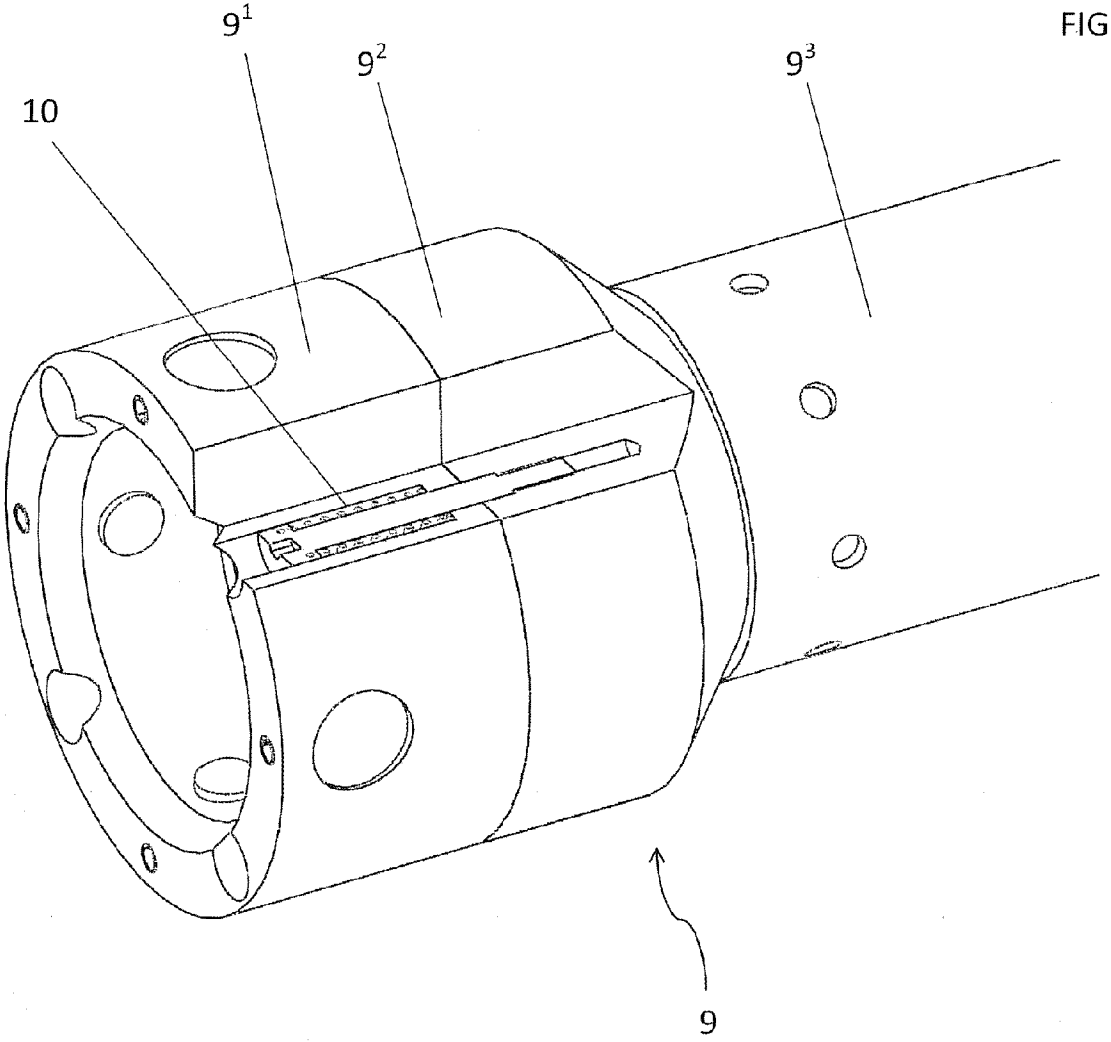
FIG. 3 shows a perspective view of the second tool.

FIG. 3 shows a perspective view of elastic means (10) located between the first portion ($9^1$) and the second portion ($9^2$) of the second tool (9), the second portion ($9^2$) of the second tool (9) comprising a rod ($9^3$).

Figure 4:
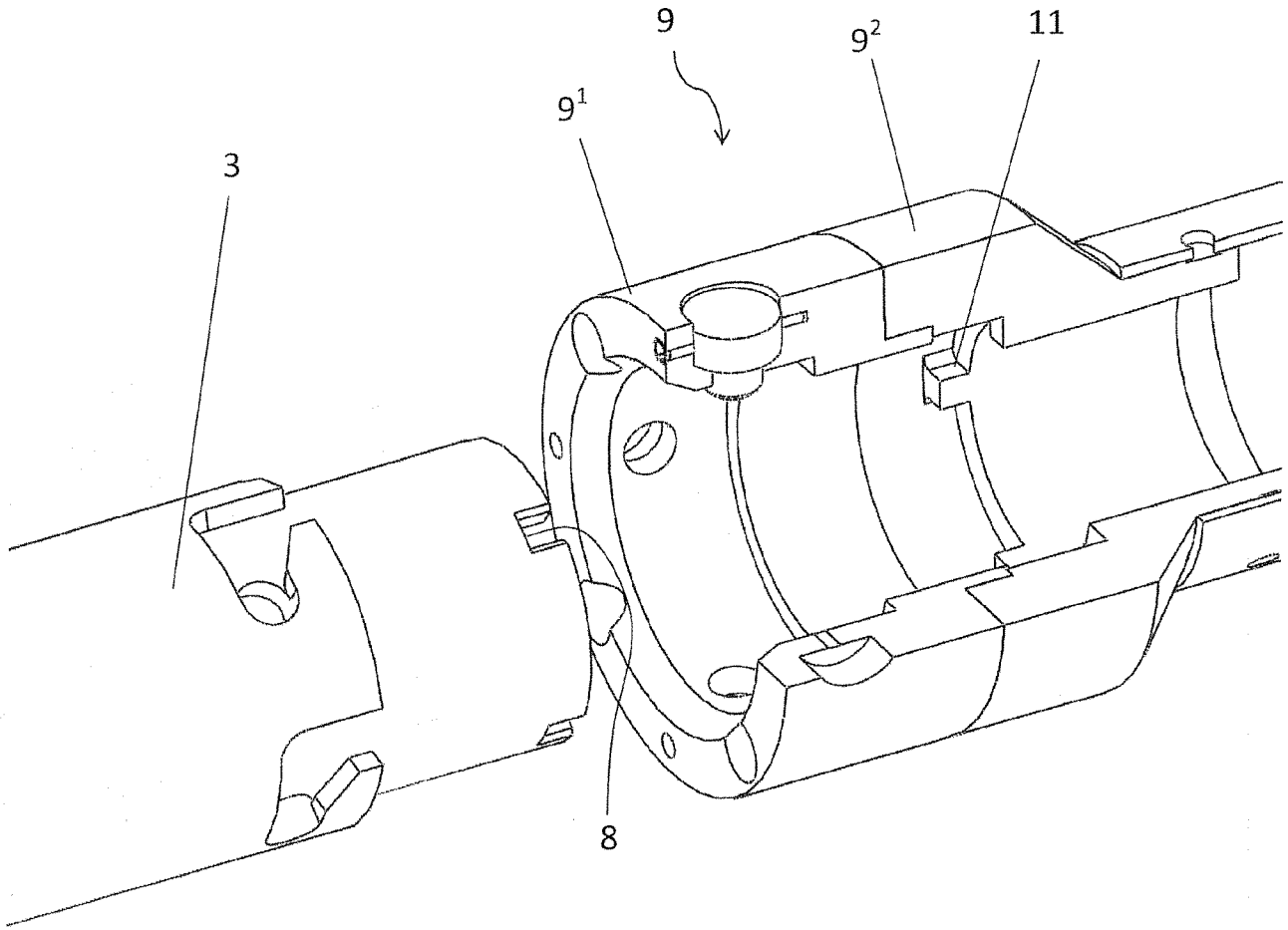
FIG. 4 shows the means of the first and second tools suitable for antirotation.

FIG. 4 shows a perspective view of the first tool (3) having the shape of a rod provided with a recess (8) suitable for the antirotation of the first tool (3), the first portion ($9^1$) of the second tool, and the second portion ($9^2$) of the mentioned second tool (9). The second portion ($9^2$) of the mentioned second tool (9) comprises a tooth (11) suitable for being inserted into the antirotation recess (8) of the first tool (3). As a matter of fact, the presence of the tooth (11) of the second tool (9) accommodated in the recess (8) of the first tool (3) operates in such a way as not to allow the first tool (3) to rotate.

Pursuant to and in accordance with article 76 paragraph 3 of the Industrial Property Code, the applicant requires the conversion of the patent according to the present invention if there are causes of voidness presently not known.

The invention claimed is:

1. A thrusting device for pipes to be bent in a pipe bending machine, comprising:

a first tool shaped as a rod provided with an end which includes at least one elbow-shaped hollow portion provided with a convex female portion suitable for accommodating a male means and a recess suitable for preventing rotation of the first tool, and a ring-shaped second tool formed of two portions, said ring-shaped second tool provided with said male means suitable for being accommodated in said convex female portion of said first tool.

2. The thrusting device according to claim 1, wherein said end is an independent tool connected to the rod-shaped tool via a connection means.

3. The thrusting device according to claim 2, wherein the connection means is a screw-type connection means.

4. The thrusting device according to claim 1, further comprising elastic means placed between a first portion and a second portion of the second tool.

5. The thrusting device according to claim 4, wherein the second portion of the second tool comprises a rod.

6. The thrusting device according to claim 4, wherein the first tool is provided with a recess suitable for preventing rotation of the first tool, and the second portion of the second tool includes a tooth suitable for being inserted into the recess of the first tool.

* * * * *